US005844527A

United States Patent [19]

Takashima et al.

[11] Patent Number: 5,844,527

[45] Date of Patent: Dec. 1, 1998

[54] RADAR ANTENNA

[75] Inventors: Tetsuya Takashima; Koji Yano; Tadashi Ozaki, all of Nishinomiya, Japan

[73] Assignee: Furuno Electric Company, Limited, Hyogo, Japan

[21] Appl. No.: 938,673

[22] Filed: Sep. 26, 1997

Related U.S. Application Data

[63] Continuation of Ser. No. 724,238, Sep. 30, 1996, abandoned, which is a continuation of Ser. No. 318,664, filed as PCT/JP94/00198 Feb. 10, 1994, abandoned.

[30] Foreign Application Priority Data

Feb. 12, 1993 [JP] Japan ..... 5-047260

[51] Int. Cl.[6] ..... H01Q 19/19

[52] U.S. Cl. ..... 343/781 P; 343/781 CA; 343/840

[58] Field of Search ..... 343/781 P, 781 CA, 343/840, 761, 839; 29/600; H01Q 19/18, 19/19

[56] References Cited

U.S. PATENT DOCUMENTS

| | | | |
|---|---|---|---|
| 2,549,721 | 4/1951 | Straus et al. | 343/781 P |
| 3,029,431 | 4/1962 | Miller | 343/756 |
| 3,562,753 | 2/1971 | Tanaka et al. | 343/781 CA |
| 3,911,441 | 10/1975 | Stein | 343/872 |
| 4,866,457 | 9/1989 | Hogg | 343/781 CA |

FOREIGN PATENT DOCUMENTS

| | | |
|---|---|---|
| 2-87807 | 3/1990 | Japan . |
| 2-238702 | 9/1990 | Japan . |

*Primary Examiner*—Michael C. Wimer

[57] ABSTRACT

Radio waves from the point f2 of the horn 7 are reflected in the diagonal direction at the sub reflector 3 for transmitting and receiving the radio waves and then further reflected at the main reflector 5 so that a fan-shaped beam narrow in the lateral direction is designed to direct in the horizontal direction, and the main reflector 5, the sub reflector 3, and the horn 7 are built into an antenna proper which is designed to be rotatable around the vertial axis 8 passing the point f2 with the rotating means 23, 24, 25 so that the structure is simplified and manufacturing costs are reduced. In order to simplify the structure of the power feeder for the antenna proper, the radar antenna comprises three sections; namely, the antenna proper 1, the cover 30, and the container 28, the container 30 rotatably supporting the antenna 1 and having a waveguide 26 to be connected to the rotating means 24, 25 for rotating the antenna proper 1 and the horn 7, the container 28 being designed to house a circuit board 36, to which a transmitting pulse oscillator 31 and a frequency converter 33 to be connected to the waveguide 26 are mounted and a modulation circuit 37 of the transmitting pulse oscillator 31 and an intermediate frequency conversion circuit 38 of the frequency converter 33 are provided.

29 Claims, 5 Drawing Sheets

RADAR ANTENNA

This application is a continuation, of application Ser. No. 08/724,238, filed on Sep. 30, 1996, which is a continuation of Ser. No. 08/318,664 filed as PCT/JP94/00198, Feb. 10, 994, now abandoned.

TECHNICAL FIELD

This invention relates to radar antennas which use a sub reflector, and more particularly to a radar antenna which is downsized, has less number of parts, and is suited for being loaded on small-size ships.

BACKGROUND ART

For radar antennas loaded on a small-size ship, a slot array type is generally used. The slot-array type radar antenna has a structure with a large number of slots with specified inclination cut on one surface of a long and narrow waveguide having a square cross section, forms a fan-shaped beam which is narrow in the longitudinal direction of the waveguide and extends in the cross-sectional direction thereof, and rotates the fan-shaped beam around the longitudinal center of this waveguide.

In the microwave communication field, such as satellite broadcasting, a fixed transmitter-receiver antenna is used. For this transmitter-receiver antenna, a parabola antenna which generates a pencil-shaped beam is generally used. However, it is necessary to place a primary radiator at the focus. So, for example, a side feed offset Cassegrainian antenna is proposed, which combines a sub-reflector having a rotating hyperbolic surface with a parabolic main reflector and locates the primary radiator outside the radio wave passage.

The slot array-type radar antenna as described above has a disadvantage of high costs because it is requires a large number of slots to be precisely machined.

SUMMARY OF THE INVENTION

Accordingly, it is an object of the invention to provide a radar anntenna that irradiates a fan-shaped beam 360° in all directions and receives reflected waves from the target and to provide a radar antenna proper which does not require any precision machining and can be produced at low cost.

Another object of the invention is to provide a radar antenna, in which not only the radar antenna proper but also the structure of the power feed is simple and inexpensive.

The objects of the present invention are achieved by providing an antenna which is designed to reflect radio waves transmitted and received from the point f2 of the horn 7 diagonally at the sub reflector 3 and further at the main reflector so that a fan-shaped beam narrow in the lateral direction is directed to the horizontal direction and is also designed to have this main reflector 5, sub reflector 3, and horn 7 rotated around the vertical axis 8 passing the point f2 by the rotating means 23, 24, 25.

That is, the radar antenna is a combination of the sub reflector 3 and the main reflector 5, and the antenna proper can be simplified and manufactured at low costs by press-forming integrally with a common plate. Because the sub reflector 3 and the main reflector 5 are rotated around the horn 7 with the rotating means 23, 24, 25, the structure from the horn 7 to the power feeder can be simplified by using a rotary joint 22, enabling the manufacture at lower costs than that of slot array type radar antennas.

In order to improve matching of the radio waves radiated from the horn 7 with the sub reflector 3 and the irradiation characteristics of the antenna, an inclined plate 9 whose aperture extends in the transverse cross direction with respect to the sub reflector 3 is installed at the outlet of the horn 7.

In addition, in order to achieve the constant reflection condition at the sub reflector 3 and main reflector 5 as well as to improve the radiation characteristics of the antenna, a horizontal surface which is a surface opposite to the sub reflector 3 and displaced in the vertical direction to prevent interference with the main reflector is installed.

For simplifying the structure of the power feeder for the antenna proper 1, the radar antenna is designed to comprise three components; namely, an antenna proper 1, cover 30, and container 28; the cover 30 having a waveguide 26 which is connected to the rotating means 24, 25 for rotating the antenna proper 1 and the horn 7; the container 28 being equipped with a transmitting pulse oscillator 31 and a frequency converter 33 which are connected to the waveguide 26 and being designed to house a circuit board 36 equipped with a modulation circuit 37 of the transmitting pulse oscillator 31 and an intermediate frequency conversion circuit 38 of the frequency converter 33.

It is recommended to install to the circuit board 36 a driving circuit 39 of the rotating means 25 and a communication circuit 40 for the indicator for further integration.

It is also recommended to install a shield plate 42 which separates a modulation circuit 37 from the intermediate frequency conversion circuit 38 to the cover 30 in order to prevent influence of the noise of the modulation circuit 37 on the intermediate frequency conversion circuit 38.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

BEST MODE FOR CARRYING OUT THE INVENTION

Figure 1:
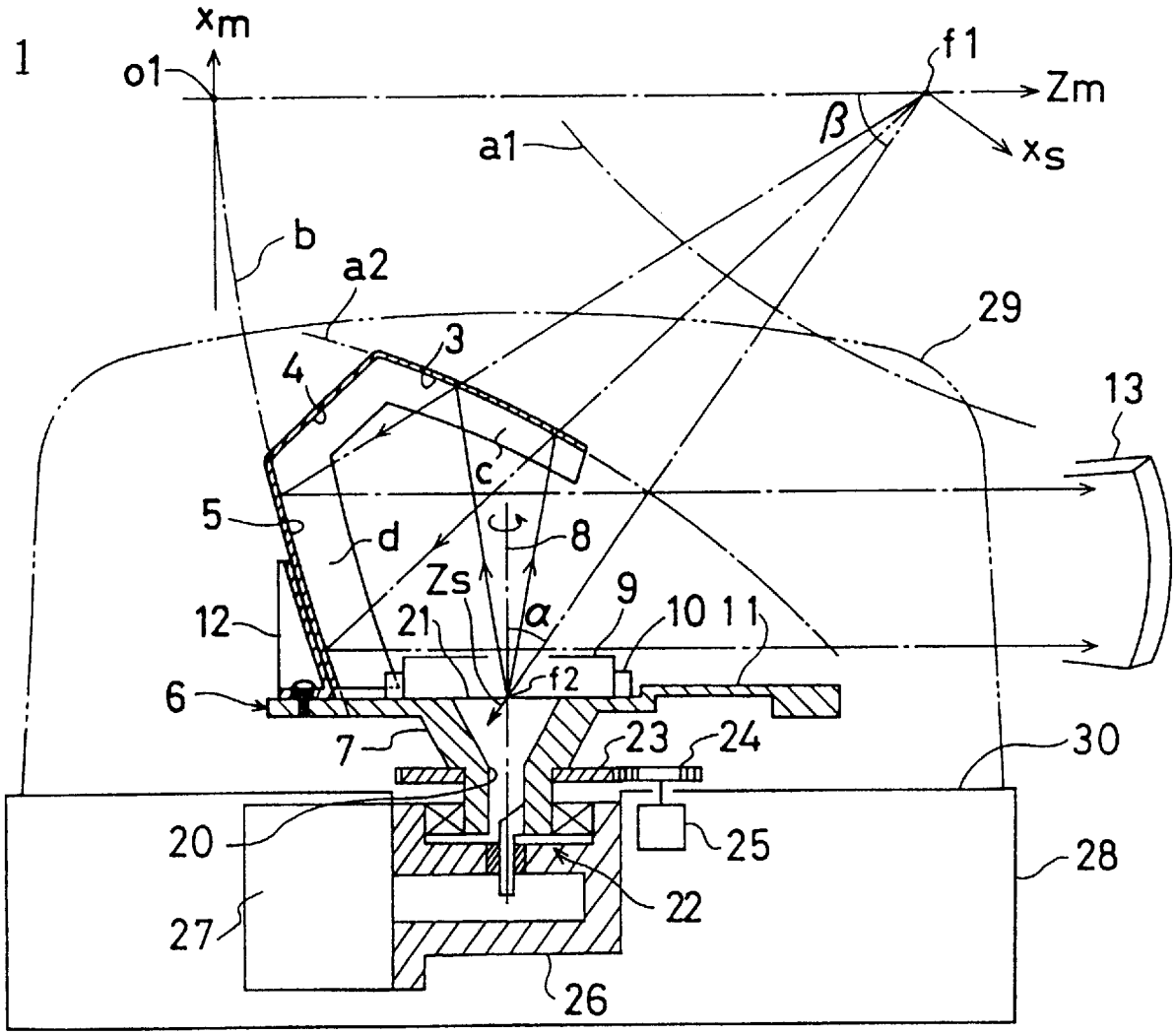
FIG. 1 is a longitudinal sectional view of the radar antenna according to the present invention.

Referring now to the drawings, preferred embodiments of the radar antenna according to the present invention will be described in detail.

Figure 3:
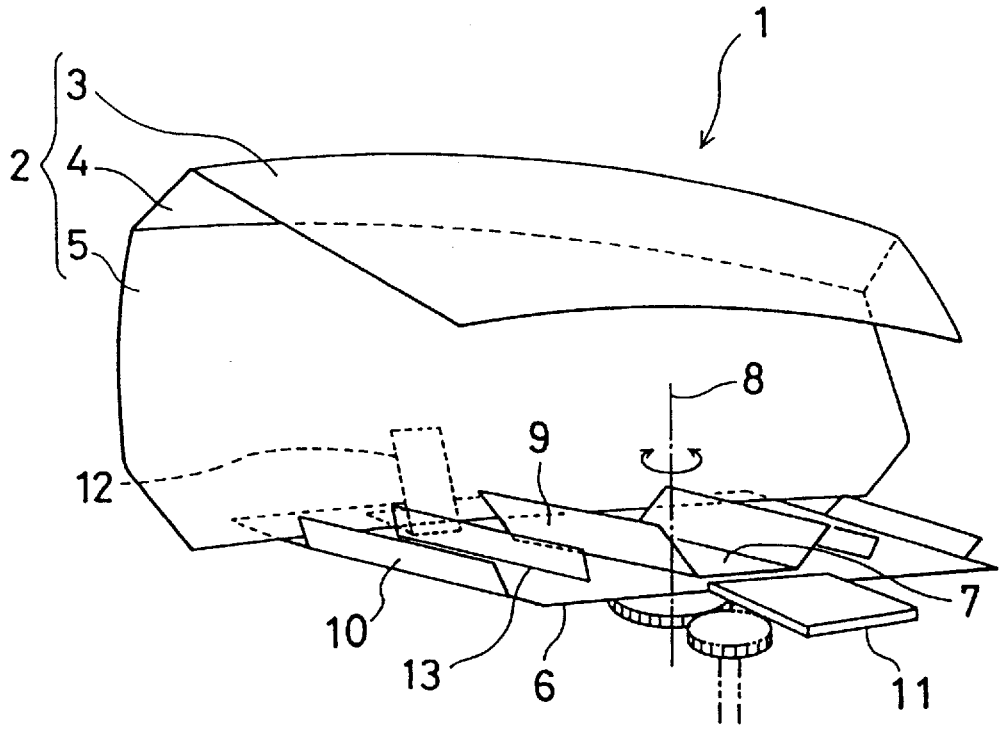
FIG. 3 is a perspective view of the antenna proper of the present invention.

First of all, referring to an embodiment of the invention in FIG. 3, the structure of the antenna proper 1 is described.

Numeral 2 is a formed aluminum plate comprising a sub reflector 3, a joint 4, and a main reflector 5. This formed aluminum plate 2 is fixed to the base 6 which also serves as a reflector plate. At the center of the base 6, a horn 7 is installed in such a manner to rotate around the vertical axis 8 via a rotary joint not illustrated. To the base 6, the first inclined plate 9 as extensions of both sides of the horn 7, the second inclined plate 13, the third inclined plate 10 on both ends, and a balance weight 11 are installed. The installation method of these inclined plates 9, 10, 11 may be varied in many ways in accordance with the required antenna characteristics.

The formed aluminum plate 2 having a sub reflector 3 and main reflector 5 is press-formed from one common aluminum plate with dies having a specified form. The base 6 is an aluminum die cast product integrally having a horn 7, inclined plates 9, 10, 13, and balance weight 11. The formed aluminum plate 2 is fixed to the edge of the base 6 via the bracket 12, constituting a compact antenna proper 1 as a whole. The inclined plates 9, 10, 13 and the balance weight 11 may be made as individual components by sheet metal processing and mounted to the base 6.

Figure 2:
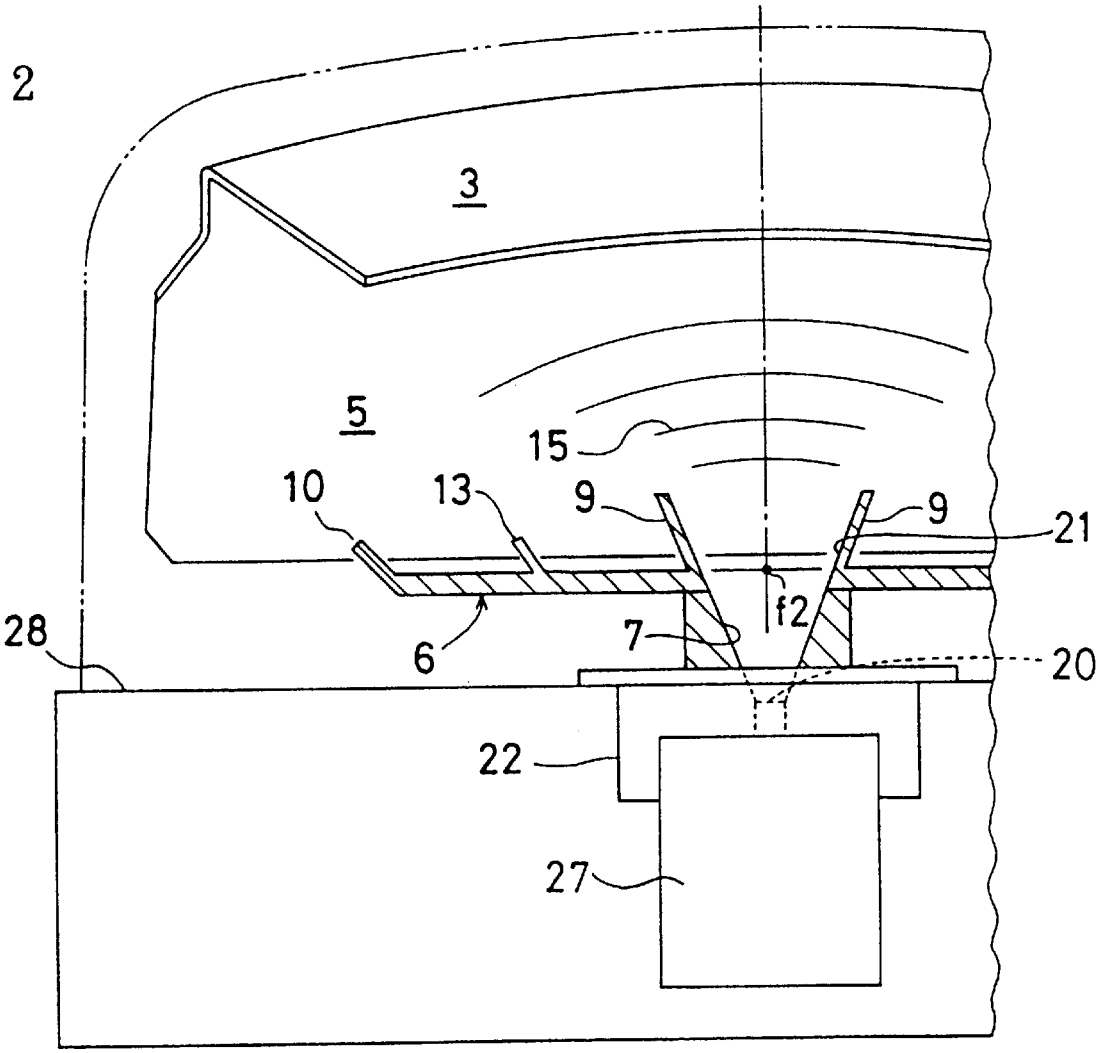
FIG. 2 is a transverse sectional view of the radar antenna according to the present invention.

Now, referring to FIGS. 1 and 2, description will be made on the curved surface profile of the sub reflector 3 and main reflector 5. In FIG. 1, the sub reflector 3 is arranged in such a manner to reflect diagonally downwards the radio waves transmitted and received upwards from the point f2 of the horn 7, has part of the other curved surface a2 of the hyperbolas a1, a2 having focal points f1, f2 designated as a longitudinal cross section, and comprises part of a rotating hyperboloid ϵ formed when the sub reflector 3 is rotated around the line Zs connecting focal points f1, f2 as a center axis. The equation of this rotating hyperboloid ϵ is expressed as $$(Zs-c)^2/a^2-(Xs^2+Ys^2)/(c^2-a^2)=1.$$

In this event, radio waves radiated from one focal point f2 are reflected by the inner surface of the subreflector 3 and change the direction as if they are radiated from the other focal point f1.

The main reflector 5 is arranged in such a manner to reflect radio waves from the sub reflector 3 to the horizontal direction, has part of the parabola b with the other focal point f1 as a focus as a longitudinal cross section, and comprises part of a rotating paraboloid d formed when the main reflector 5 is rotated around the horizontal line Zm as a rotating axis, which passes the vertex 01 of the parabola b and the other focal point f1.

In this event, the radio waves reflected by the sub reflector 3 are also reflected at the main reflector 5 and are shifted to the horizontal direction. In order to achieve this kind of direction change, the following relational equation is satisfied for the positions of the sub reflector 3 and main reflector 5.

$$\tan(\alpha/2)=m\times\tan(\beta/2)$$

where, $$m=(c+a)/(c-a)=(e+1)/(e-1),\ e=c/a$$

As shown in FIG. 3, the sub reflector 3 and main reflector 5 are designed to be long and narrow, with the longitudinal cross section longer than the transverse cross section. As the ratio of longitudinal to transverse cross section in the practical reflection surface grows smaller and the shape becomes longer and narrower, a fan-shaped beam 13 narrow in the lateral direction is formed. This longitudinal to transverse ratio is determined to an optimum value in accord with the fan beam 13 to be formed.

Next discussion is made on the structure of the base to which the sub reflector 3 and the main reflector 5 are mounted. The base 6 is rectangular, at the center of which a horn 7 is mounted. As shown in FIGS. 1 and 2, the horn 7 is a quadrangular pyramid extending from a small rectangular aperture 20 to a large rectangular aperture 21, and has its profile set in such a manner that the focal point f2, also the radiation point, is located near the center of the large rectangular aperture 21. Below the horn 7, a rotary joint 22 is arranged and the entire base 6, that is, the antenna proper 1, is designed to be rotatable around the vertical center axis 8.

Next description is made on the rotating means 23, 24, 25 of this antenna proper 1. A hollow gear 23 is mounted on the periphery of the horn 7 below the base 6, and meshes with a pinion 24 coupled to the driving motor 25, enabling the base 6 to make a controlled, specified rotation.

That is, the center axis of the horn 7 is designed to coincide with the vertical axis 8, which also serves as a rotation axis. The rotary joint 22 rotatably arranges one (on the side connected to the horn 7) of a pair of waveguides located oppositely with the axis in between via a bearing, while it arranges the other waveguide (the one to be connected to the waveguide 26 later discussed) on the fixed side. To this rotary joint 22, a waveguide 26 is connected, and to the edge of the waveguide 26, a transmitting pulse oscillator 31 and a frequency converter 33 are connected via a circulator 27. These waveguide 26, transmitting pulse oscillator 31, frequency converter 33, and a circuit board later discussed compose the power feed, achieving the simplest structure. The use of the rotary joint 22 and the waveguide 26 enables a power feed which has a simple arrangement.

These components such as driving motor 25, waveguide 26, etc. are stored in the container 28 and cover 30. The The sub reflector 3 and the main reflector 5 are housed in a plastic dome 29 and forms a compact rotating type warning signal light shape as a whole. The balance weight 11 is installed on the side opposite to the reflectors 3, 5 so that the position of the center of gravity is held near the vertical axis 8 of the base 6.

At the outlet of the horn 7 of the base 6, the first inclined plate 9 along the radiation direction of radio waves is installed. As clearly shown in FIG. 2, this first inclined plate 9 is installed along or parrallel to the horn 7. However, it is not installed in the longitudinal direction of the main reflector 5, thereby minimizing the portion that interrupts radio waves. With this first inclined plate 9, the radio waves 15 radiated from the horn 7 maintain spherical waves, improving matching to the sub reflector 3. Installing the first inclined plate 9 and the second inclined plate 13 on both sides of the horn 7 and the third inclined plate 10 on both edges of the base 6 improve the radiation characteristics of the antenna.

The surface facing the sub reflector 3 of the base 6 is formed into a flat reflecting surface. The absence of this reflecting surface of the base 6 reflects radio waves deflecting from the sub reflector 3 and the main reflector 5 against the surface of the container 28. However, because the surface of the container 28 is irregular and the sub reflector 3 and the main reflector 5 rotate, the reflecting condition varies and there is a fear of phase deviation of radio waves. Therefore, the base 6 that rotates together with the sub reflector 3 and main reflector 5 is designed to be a reflecting surface to prevent deviation of the phase.

Next, referring to FIG. 1, the operation of the antenna proper 1 is described. The radio waves radiated upwards from the focal point f2 of the horn 7 become spherical waves to reach the sub reflector 3 and are reflected diagonally downwards with respect to the main reflector 5. In radiating radio waves from the horn 7, matching to the sub reflector 3 is achieved by the first inclined plate 9. The radio waves reflected at the main reflector 5 become horizontal. The sub reflector 3 and the main reflector 5 are long and narrow, forming radio waves into a fan-shaped beam 13 narrow in the lateral direction. The sub reflector 3 and the main reflector 5 rotate around the vertical axis of the horn 7 and radiate a fan-shaped beam 13 at 360° in all directions. The operation described above is applied to the case of transmission, and in the case of receiving, the same principles apply but in the reverse direction.

The joint 4 between the sub reflector 3 and the main reflector 5 is not needed from the viewpoint of the radio wave reflection and can be omitted. The sub reflector 3 and the main reflector 5 may be press-formed separately with an aluminum plate and combined by bolting. The horn 7 of FIG. 1 may be arranged on the top side and the relationship between the main reflector 5 and the sub reflector 3 may be inverted.

Figure 4:
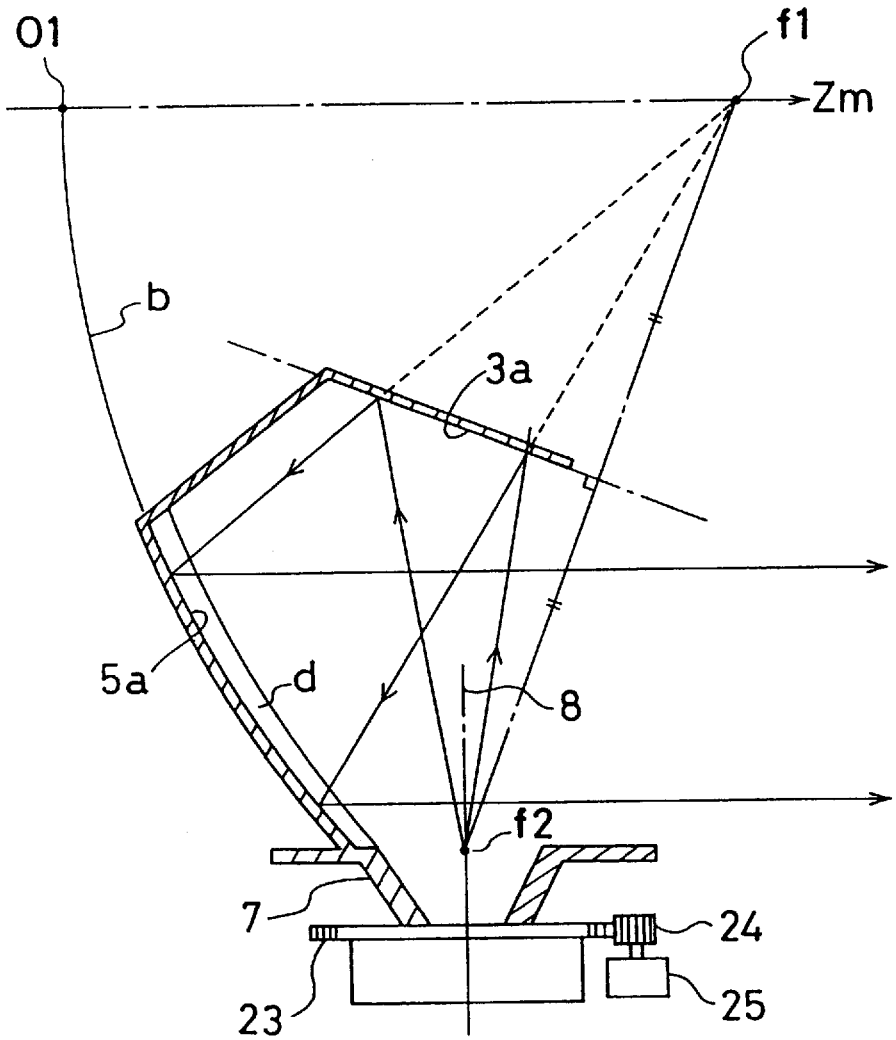
FIG. 4 is a longitudinal sectional view of the other antenna proper according to the present invention.

FIG. 4 is a longitudinal cross sectional view of the other antenna proper. The point in which radio waves radiated upwards from the radiation point of the horn 7 are reflected diagonally downwards at the sub reflector 3*a* and reflected horizontally at the main reflector 5*a* is the same as that in FIG. 1. The point, in which the main reflector 5*a* uses part of the parabola b with the focal point f1 as a longitudinal cross section and is formed by part of the rotating paraboloid d formed when the main reflector 5*a* is rotated around the horizontal line Zm passing the vertex 01 of the parabola b and the focal point f1, is also same as that in FIG. 1. However, the point in which the sub reflector 3*a* is a simple plate arranged along a bisector connecting the radiation point f2 with the focal point f1 differs from that in FIG. 1. That is, the plate 3*a* is designed to be symmetrical to the radiation point f2 and the focal point f1. Consequently, when radio waves radiated from the radiation point f2 of the horn 7 are reflected at the sub reflector 3*a*, they are reflected as if they are radiated from the focal point of the parabola b and when they are reflected at the main reflector 5*a*, they become horizontal radio waves. Compared with the sub reflector 3 in FIG. 1, the sub reflector 3*a* in FIG. 3 is located farther from the horn 7 but achieves higher accuracy because it is planar.

Figure 5:
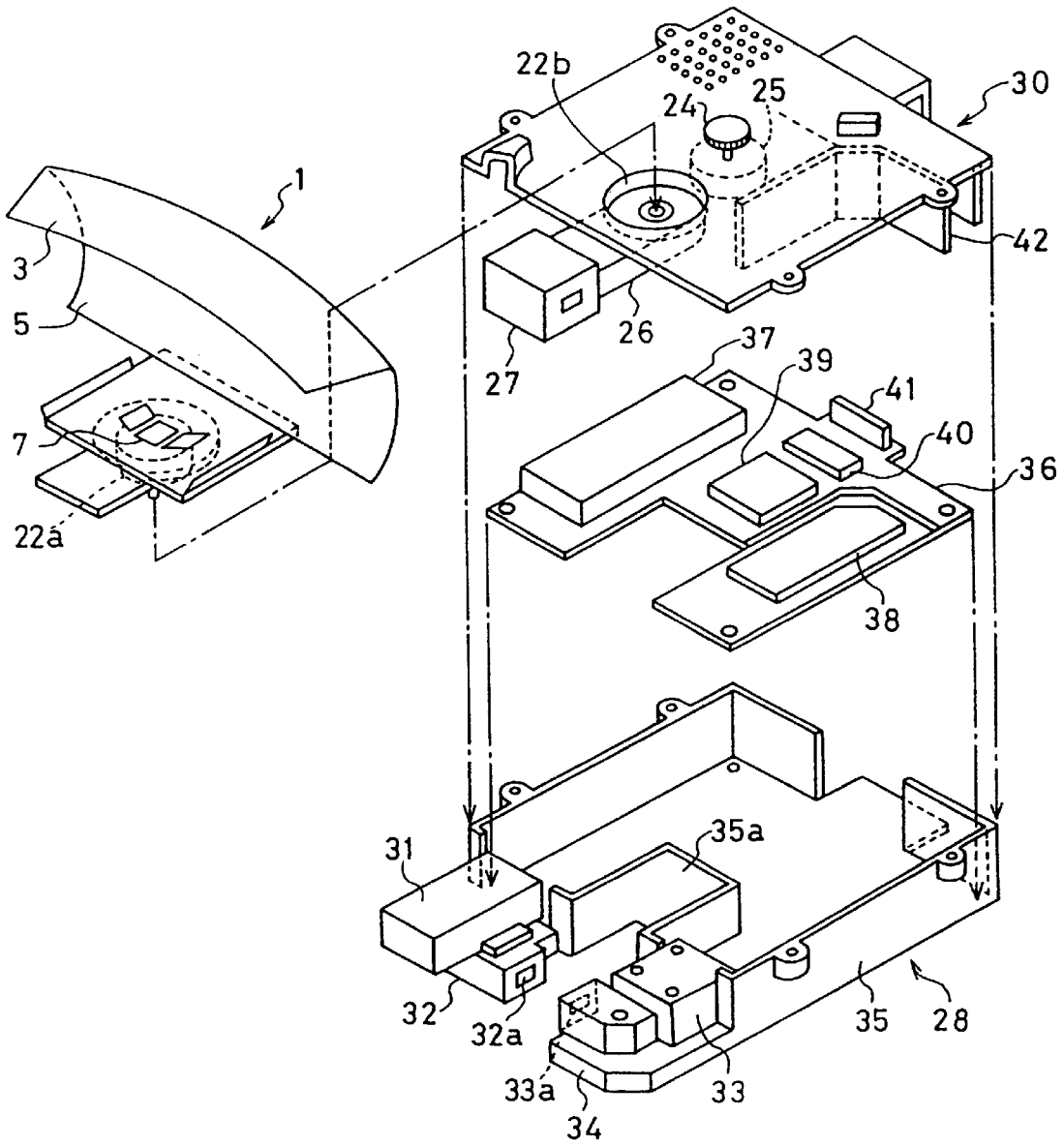
FIG. 5 is an exploded perspective view of the radar antenna according to the present invention.

FIG. 5 is an exploded perspective view of the radar antenna. This radar antenna is designed to be disassembled in three parts, namely, the antenna proper 1, the cover 30, and the container 28. The antenna proper 1 has the similar structure as that described in FIG. 1, and can be separated from the cover 30 at the rotary joints 22*a*, 22*b*.

The cover 30 is made by aluminum die casting and the rotary joint 22*b*, the waveguide 26 that follows, and the circulator 27 at the top end are tightened with bolts. The motor driving the pinion 24 is installed on the bottom surface of the cover 30.

The container 28 is also made by aluminum die casting and the seating 32 to which the transmitting pulse oscillator 31 is mounted, the seating 34 to which the frequency converter 33 is mounted, and the surrounding wall 35 are integrally formed. On part of the wall 35, a concave type dent 35*a* is formed, in which the waveguide 26 enters. Connection is achieved by fitting the circulator 27 into a clearance between the wave guide inlet 32*a* of the seating 32 and the wave guide inlet 33*a* of the frequency converter 33.

In this container 28, a circuit board 36 is housed and fixed with bolts, etc. The circuit board 36 is mounted with a modulation circuit 37 for transmitting specified radio waves from the transmitting pulse oscillator 31, an intermediate frequency converter circuit 38 for amplifying weak radio waves received by the frequency converter 33, a driving circuit 39 for the driving motor 25, a communication circuit 40 for the indicator, and connection terminals 41. In this way, installing circuits 37, 38, 39, 40 to one circuit board can downsize the circuit and reduce costs. However, in order to prevent influence of noise generated from the modulator circuit 37 through which large current flows on the intermediate frequency conversion circuit 38 for amplifying weak current, a shield plate 42 is installed to the cover 30 to separate the intermediate frequency conversion circuit 38 by the wall 35 and the shield plate 42. Conventionally, the intermediate frequency conversion circuit 38 and the modulator circuit 37 were installed on separate circuit boards and were designed to mount to remote locations for a countermeasure against noise.

In assembling, the antenna proper 1, the cover 30, and the container 28 are assembled separately, and after inspection, the cover 30 is placed on the container 28 and fixed with bolts, and the rotary joint 22*b* of the cover 30 and the rotary joint 22*a* of the antenna proper 1 are fitted to complete assembly. Separating the radar antenna in three sections and integrating circuits into one circuit board 36 can simplify the structure and enables the manufacture at low costs.

As described above, the radar antenna according to the present invention is suited for the application in which the radar antenna is carried on small-size ships such as leisure boats and fishing boats, and particularly suited for the application in which the radar antenna irradiates a fan-shaped beam 360° in all directions to receive reflected waves from the target.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A cassegrain radar antenna for transmitting and receiving substantially horizontally directed radar signals, comprising:

a horn for transmitting radar radiation from a first point, a subreflector having a shape corresponding to a portion of a hyperboloid surface which is defined by a hyperbola rotated around an axis, wherein said subreflector includes first and second hyperbolic focal points corresponding to the first point and a second point and wherein the axis connects the first and second hyperbolic focal points, a main reflector receiving the radar radiation from said subreflector and reflecting the radar radiation in a substantially horizontal direction having a shape corresponding to a portion of a paraboloid surface which is defined by a parabola rotated around a horizontal axis that substantially coincides with a vertex of the parabola wherein said main reflector has a parabolic focal point which substantially coincides with the second hyperbolic focal point of said subreflector wherein the horizontal axis substantially passes through the vertex and the second hyperbolic focal point of said subreflector, and said horn being connected to said main reflector via a base;

said main reflector being coupled to said subreflector via a joint;

said horn supporting said main reflector, said subreflector, said base and said point;

rotating means for integrally rotating the main reflector and the subreflector around a vertical axis passing the first hyperbolic focal point, said rotating means further rotating the horn around the vertical axis passing the first hyperbolic focal point, wherein the cassegrain radar antenna also receives radar echo signals and directs the received radar echo signals to the horn via said main reflector and said subreflector.

2. The cassegrain radar antenna as claimed in claim 1, wherein the horn is rotatably supported with a rotary joint.

3. The cassegrain radar antenna as claimed in claim 1, wherein said subreflector and said main reflector are integrally press-formed from a common plate.

4. The cassegrain radar antenna as claimed in claim 1, wherein said subreflector and said main reflector are formed by die casting.

5. A cassegrain radar antenna for transmitting and receiving substantially horizontally directed radar signals, comprising:

a horn for transmitting radar radiation from a first point;

a subreflector having a shape corresponding to a portion of a hyperboloid surface which is defined by a hyperbola rotated around a first axis, wherein said subreflector includes first and second hyperbolic focal points corresponding to the first point and a second point and wherein the axis connects the first and second hyperbolic focal points, a main reflector receiving the radar radiation from said subreflector and reflecting the radar radiation in a substantially horizontal direction having a shape corresponding to a portion of a paraboloid surface which is defined by a parabola rotated around a horizontal axis that substantially coincides with a vertex of the parabola wherein said main reflector has a parabolic focal point which substantially coincides with the second hyperbolic focal point of said subreflector wherein the horizontal axis substantially passes through the vertex and the second hyperbolic focal point of said subreflector, and said horn being connected to said main reflector via a base;

said main reflector being coupled to said subreflector via a joint;

said horn supporting said main reflector, said subreflector, said base and said joint;

inclined plates installed at the outlet of the horn having an aperture between said inclined plates that expands in the transverse cross direction with respect to the subreflector, and rotating means for integrally rotating said main reflector, said subreflector and said inclined plates around a vertical axis passing the first hyperbolic focal point, said rotating means further rotating the horn around the vertical axis passing the first hyperbolic focal point, wherein the cassegrain radar antenna also receives radar echo signals and directs the received radar echo signals to the horn via said main reflector and said subreflector.

6. A cassegrain radar antenna for transmitting and receiving substantially horizontally directed radar signals, comprising:

a horn for transmitting radar radiation from a first point;

a subreflector having a shape corresponding to a portion of a hyperboloid surface which is defined by a hyperbola rotated around a first axis, wherein said subreflector includes first and second hyperbolic focal points corresponding to the first point and a second point and wherein the first axis connects the first and second hyperbolic focal points, a main reflector receiving the radar radiation from said subreflector and reflecting the radar radiation in a substantially horizontal direction having a shape corresponding to a portion of a paraboloid surface which is defined by a parabola rotated around a horizontal axis that substantially intersects a vertex of the parabola wherein said main reflector has a parabolic focal point which substantially coincides with the second hyperbolic focal point of said subreflector wherein the horizontal axis substantially intersects the vertex and the second hyperbolic focal point of said subreflector, and said horn being connected to said main reflector via a base and a bracket;

said main reflector being coupled to said subreflector via a joint;

said horn supporting said main reflector, said subreflector, said base, said bracket, and said Joint;

a reflection plate facing towards said subreflector and installed on a horizontal surface which is vertically displaced so as to prevent interference with said main reflector, and rotating means for integrally rotating said main reflector, said subreflector and said reflection plate around a vertical axis passing through the first hyperbolic focal point, said rotating means further rotating the horn around the vertical axis passing the first hyperbolic focal point, wherein the cassegrain radar antenna also receives radar echo signals and directs the received radar echo signals to the horn via said main reflector and said subreflector.

7. A cassegrain radar antenna for transmitting and receiving substantially horizontally directed radar signals, comprising:

a horn for transmitting radar radiation from a first point, a subreflector having a shape corresponding to a portion of a hyperboloid surface which is defined by a hyperbola rotated around a first axis, wherein said subreflector includes first and second hyperbolic focal points corresponding to the first point and a second point and wherein the first axis connects the first and second hyperbolic focal points, a main reflector receiving the radar radiation from said subreflector and reflecting the radar radiation in a substantially horizontal direction having a shape corresponding to a portion of a paraboloid surface which is defined by a parabola rotated around a horizontal axis that substantially intersects a vertex of the parabola wherein said main reflector has a parabolic focal point which substantially coincides with the second hyperbolic focal point of said subreflector wherein the horizontal axis substantially intersects the vertex and the second hyperbolic focal point of said subreflector, said horn being connected to said main reflector via a base and a bracket;

said main reflector being coupled to said subreflector via a joint;

said horn supporting said main reflector, said subreflector, said base, said bracket, and said joint;

a reflection plate facing towards said subreflector and installed on a horizontal surface which is vertically displaced so as to prevent interference with said main reflector, inclined plates installed at an outlet of said horn having an aperture between said inclined plates that expands in the transverse cross direction with respect to said subreflector and rotating means for integrally rotating said main reflector, said subreflector, said reflection plate and said inclined plates around a vertical axis passing through the first hyperbolic focal point, said rotating means further rotating the horn around the vertical axis passing the first hyperbolic focal point, wherein the cassegrain radar antenna also receives radar echo signals and directs the received radar echo signals to the horn via said main reflector and said subreflector.

8. A radar antenna for transmitting and receiving radar signals in a substantially horizontal direction comprising:

a horn for transmitting electromagnetic radiation from a first point, a planar subreflector arranged so as to reflect electromagnetic radiation from said horn diagonally, a main reflector receiving the radar radiation from said subreflector and reflecting the radar radiation in a substantially horizontal direction having a shape corresponding to a portion of a paraboloid surface which is defined by a parabola rotated around a first axis, wherein said parabola has a focal point and a vertex, and wherein the focal point and the first point are symmetrized with respect to said planar subreflector and wherein the first axis corresponds to a horizontal line substantially passing through the focal point and the vertex, and said horn being connected to said main reflector via a base and a bracket;

said main reflector being coupled to said subreflector via a joint;

said horn supporting said main reflector, said subreflector, said base, said bracket, and said joint;

rotating means for integrally rotating the main reflector and the subreflector around a vertical axis passing the first point, said rotating means further rotating the horn around the vertical axis passing the first point, wherein the antenna also receives radar echo signals and directs the received radar echo signals to the horn via said main reflector and said planar subreflector.

9. A radar antenna system for transmitting and receiving substantially horizontally directed electromagnetic radar signals comprising:

an antenna having a horn for transmitting and receiving electromagnetic radar radiation from a first point, a subreflector arranged so as to reflect the electromagnetic radar radiation from the horn diagonally, and a main reflector arranged so as to reflect the electromagnetic radiation from the subreflector in a substantially horizontal direction, said horn being connected to said main reflector via a base and a bracket;

said main reflector being coupled to said subreflector via a joint;

said horn supporting said main reflector, said subreflector, said base, said bracket, and said joint;

a cover having rotating means for supporting and rotating said antenna and a waveguide connected to the horn so as to direct the substantially horizontal radar radiation in an azimuth direction, a container having a transmitting pulse oscillator and frequency convertor respectively connected to the waveguide, said container being closed by said cover, and a circuit board disposed in a space between a bottom of said container and said cover, said circuit board including a modulator circuit for the transmitting pulse oscillator and an intermediate frequency conversion circuit for the frequency convertor.

10. The radar antenna system claimed in claim 9 wherein a shield plate fixed to said cover for separating the modulator circuit from the intermediate frequency conversion circuit mounted on said circuit board.

11. The radar antenna system claimed in claim 9 wherein a driving circuit for driving the rotating means and a communication circuit are mounted on said circuit board.

12. A cassegrain radar antenna for transmitting and receiving substantially horizontally directed electromagnetic radar signals, comprising:

a horn for transmitting electromagnetic radar radiation from a first point in a substantially vertical direction;

a subreflector having a shape corresponding to a portion of a hyperboloid surface which is defined by a hyperbola rotated around an axis and having a first and second focal point wherein the axis connects the first and second focal points, said subreflector arranged such that the first focal point corresponds to the first point such that said subreflector reflects the electromagnetic radar radiation from the substantially vertical direction in a substantially downward and diagonal direction;

a main reflector having a shape corresponding to a portion of a paraboloid surface which is defined by a parabola rotated around a horizontal axis that substantially intersects a vertex of the parabola, said main reflector reflecting the substantially downwardly and diagonally directed electromagnetic radar radiation from the subreflector in a substantially horizontal direction; and said horn being connected to said main reflector via a base and a bracket;

said main reflector being coupled to said subreflector via a joint;

said horn supporting said main reflector, said subreflector, said base, said bracket, and said joint;

rotating means for integrally rotating the main reflector and the subreflector around a vertical axis passing through the first point to rotate the substantially horizontally directed electromagnetic radar radiation, said rotating means further rotating the horn around the vertical axis passing the first hyperbolic focal point, wherein the cassegrain radar antenna also receives electromagnetic radar echo signals and directs the received electromagnetic radar echo signals to the horn via the parabolic main reflector and the hyperbolic subreflector.

13. The cassegrain radar antenna as claimed in claim 12 wherein the horn is rotatably supported with a rotary joint.

14. The cassegrain radar antenna as claimed in claim 12 wherein the subreflector and the main reflector are integrally press-formed from a common plate.

15. The antenna of claim 12, further comprising:

inclined plate means for improving radiation characteristics of the cassegrain antenna, said inclined plate means arranged parallel to the horn.

16. The antenna of claim 12, further comprising:

a reflection plate having a substantially planar surface facing the subreflector, said reflection plate arranged to prevent interference with the main reflector.

17. The cassegrain radar antenna as claimed in claim 12, wherein said subreflector and said main reflector are formed by die casting.

18. A cassegrain antenna for transmitting and receiving substantially horizontally directed radar signals, comprising:

a horn for transmitting radar radiation from a first point;

a subreflector having a shape corresponding to a portion of a hyperbola with a first and second focal point, said subreflector arranged such that the first focal point of the hyperbola corresponds to the first point of the horn such that said subreflector reflects the radar radiation from the horn as if the radar radiation originated from the second focal point of the hyperbola;

a main reflector having a shape which corresponds to a portion of a paraboloid surface which is defined by a parabola rotated around a horizontal axis that substantially intersects a vertex of the parabola, said main reflector reflecting the radar radiation from the subreflector in a substantially horizontal direction; and said horn being connected to said main reflector via a base and a bracket;

said main reflector being coupled to said subreflector via a joint;

said horn supporting said main reflector, said subreflector, said base, said bracket, and said joint;

rotating means for integrally rotating the main reflector and the subreflector around a vertical axis passing through the first point, said rotating means further rotating the horn around the vertical axis passing the first hyperbolic focal point, wherein the cassegrain antenna also receives radar echo signals and directs the received radar echo signals to the horn via the main reflector and the hyperbolic subreflector.

19. The cassegrain antenna of claim 18, further comprising:

inclined plate means for improving radiation characteristics of the cassegrain antenna, said inclined plate means arranged parallel to the horn.

20. The cassegrain antenna of claim 18, further comprising:

a reflection plate having a substantially planar surface facing the subreflector, said reflection plate arranged to prevent interference with the main reflector.

21. The cassegrain antenna of claim 18, wherein the horn transmits and receives electromagnetic radiation in an upward direction.

22. The cassegrain antenna of claim 18, wherein the horn transmits and receives electromagnetic radiation in a downward direction.

23. An antenna for transmitting and receiving radar signals in a substantially horizontal direction comprising:

a horn for transmitting radar radiation from a first point in a substantially vertical direction;

a subreflector having a planar shape arranged to reflect radar radiation from the horn in a diagonal direction;

a main reflector having a shape which corresponds to a portion of a paraboloid surface which is defined by a parabola rotated around a horizontal axis that substantially intersects a vertex of the parabola, said main reflector reflecting the diagonally directed radar radiation from the subreflector in a substantially horizontal direction; and said horn being connected to said main reflector via a base;

said main reflector being coupled to said subreflector via a joint;

said horn supporting said main reflector, said subreflector, said base and said joint;

rotating means for integrally rotating the main reflector and the subreflector around a vertical axis passing through the first point to rotate the substantially horizontally directed radar radiation, wherein the antenna also receives radar echo signals and directs the received radar echo signals to the horn via the parabolic main reflector and the subreflector.

24. A method of manufacturing a compact antenna system, comprising the steps of:

integrally press forming a main reflector, a subreflector and a joint portion that connects the main reflector and the subreflector from a single plate to form an antenna;

said horn being connected to said main reflector via a base and a bracket;

said main reflector being coupled to said subreflector via a joint;

said horn supporting said main reflector, said subreflector, said base, said bracket, and said joint;

providing a container for housing a circuit board wherein the circuit board includes a modulator circuit for transmitting desired electromagnetic radiation and an intermediate frequency conversion circuit for amplifying received electromagnetic echo signals;

fixing a cover to the container; and mounting the antenna to the cover with a rotary joint.

25. The method of claim 24 further comprising the step of mounting a shield plate to the circuit board for separating the modulator circuit from the intermediate frequency conversion circuit.

26. The method of claim 24 further comprising the steps of:

mounting a horn to the antenna, and rotating the antenna using the rotary joint.

27. The method of claim 24, further comprising the step of:

constructing the cover with a die cast process.

28. The method of claim 24, further comprising the step of:

constructing the container with a die cast process.

29. A cassegrain radar antenna for transmitting search signals and receiving echo signals in a substantial horizontal direction, comprising:

a horn for transmitting radar radiation from a first point, a subreflector having a shape corresponding to a portion of a hyperboloid surface which is defined by a hyperbola rotated around an axis, wherein said subreflector includes first and second hyperbolic focal points corresponding to the first point and a second point, respectively, and wherein the axis connects the first and second hyperbolic focal points, a main reflector receiving radar radiation from said subreflector and reflecting the radar radiation in the substantially horizontal direction having a shape corresponding to a portion of a paraboloid surface which is defined by a parabola rotated around a horizontal axis that substantially coincides with a vertex of the parabola wherein said main reflector has a parabolic focal point which substantially coincides with the second hyperbolic focal point of said subreflector;

said horn being connected to said main reflector via a base and a bracket;

said main reflector being coupled to said subreflector via a joint;

said horn supporting said main reflector, said subreflector, said base, said bracket, and said joint;

wherein the horizontal axis substantially passes through the vertex and the second hyperbolic focal point of said subreflector, wherein said subreflector and said main reflector are integrally press-formed from a common plate, and rotating means for integrally rotating said main reflector, said subreflector around a vertical axis passing through the first hyperbolic focal point;

said rotating means further rotating the horn around the vertical axis passing the first hyperbolic focal point, wherein said cassegrain radar antenna also receives radar echo signals and directs the received radar echo signals to said horn via said main reflector and said subreflector.

* * * * *